US006736911B1

(12) United States Patent
Ro et al.

(10) Patent No.: US 6,736,911 B1
(45) Date of Patent: May 18, 2004

(54) ALUMINUM ALLOY, ALUMINUM ALLOY FOIL, CONTAINER AND METHOD OF PREPARING ALUMINUM ALLOY FOIL

(75) Inventors: Akinori Ro, Izumi (JP); Masaaki Abe, Nara (JP); Yoshiki Hashizume, Kawachinagano (JP)

(73) Assignee: Toyo Aluminium Kabushiki Kaisha, Osaka (JP)

( * ) Notice: Subject to any disclaimer, the term of this patent is extended or adjusted under 35 U.S.C. 154(b) by 24 days.

(21) Appl. No.: 10/019,416

(22) PCT Filed: Jul. 3, 2000

(86) PCT No.: PCT/JP00/04435

§ 371 (c)(1),
(2), (4) Date: Dec. 21, 2001

(87) PCT Pub. No.: WO01/04369

PCT Pub. Date: Jan. 18, 2001

(30) Foreign Application Priority Data

Jul. 9, 1999 (JP) ..... 11-195772

(51) Int. Cl.[7] ..... C22C 21/00; C22F 1/04

(52) U.S. Cl. ..... 148/437; 148/692; 420/550; 420/551; 420/553

(58) Field of Search ..... 420/550, 551, 420/553; 148/437

(56) References Cited

U.S. PATENT DOCUMENTS 3,989,548 A 11/1976 Morris
4,737,198 A * 4/1988 Shabel et al. ..... 148/551
5,030,416 A * 7/1991 Werner et al. ..... 420/538

FOREIGN PATENT DOCUMENTS

| | | |
|---|---|---|
| JP | 51-97517 | 8/1976 |
| JP | 60-221546 | 11/1985 |
| JP | 61-257459 | 11/1986 |
| JP | 62-007826 | 1/1987 |
| JP | 62-149857 | 7/1987 |
| JP | 62-250143 | 10/1987 |
| JP | 3261549 | 11/1991 |
| JP | 07318084 | 12/1995 |
| JP | 10183283 | 7/1998 |

* cited by examiner

*Primary Examiner*—George Wyszomierski
*Assistant Examiner*—Janelle Combs Morillo
(74) *Attorney, Agent, or Firm*—W. F. Fasse; W. G. Fasse

(57) ABSTRACT

An aluminum alloy contains at least 0.0001 mass % and not more than 0.03 mass % of copper, at least 0.0005 mass % and not more than 0.2 mass % of silicon, at least 0.5 mass % and not more than 4 mass % of manganese and at least 0.5 mass % and not more than 3 mass % of iron, and the rest contains aluminum and unavoidable impurities. The aluminum alloy further contains at least one of at least 0.01 mass % and not more than 0.5 mass % of chromium, at least 0.01 mass % and not more than 0.5 mass % of titanium and at least 0.01 mass % and not more than 0.5 mass % of zirconium. An aluminum alloy foil is prepared by heating up the aluminum alloy to a temperature of at leas 350° C. and not more than 580° C., holding the same immediately after the heating up or retaining an ingot of the aluminum alloy at a temperature of at least 350° C. and not more than 530° C. for not more than 15 hours, thereafter performing hot rolling at a starting temperature of at least 350° C. and not more than 530° C., thereafter performing cold rolling and thereafter performing softening.

16 Claims, 2 Drawing Sheets

ALUMINUM ALLOY, ALUMINUM ALLOY FOIL, CONTAINER AND METHOD OF PREPARING ALUMINUM ALLOY FOIL

TECHNICAL FIELD

The present invention relates to an aluminum alloy, an aluminum alloy foil and a container excellent in corrosion resistance and a method of preparing an aluminum alloy foil, and more particularly, it relates to an aluminum alloy and an aluminum alloy foil for a container for a beverage or food, a building material, a food wrapping material, a domestic article and a decorative article having high strength and sufficient elongation improving formability and exhibiting excellent rollability and a method of preparing the same.

BACKGROUND ART

Among aluminum alloys, particularly those for containers for weak-acidic food containing soy sauce or sodium chloride must have sufficient corrosion resistance, strength and elongation for increasing its formability, and hence aluminum alloys such as JIS (Japanese Industrial Standard) nominal 3003, 3004 and 5052 of about 50 to 200 μm in thickness are employed in general. Table 1 shows typical compositions of these alloys.

TABLE 1

| Alloy Name | Additional Element for Aluminum Alloy (mass %) | | | | | | | |
|---|---|---|---|---|---|---|---|---|
| (JIS Nominal) | Fe | Si | Cu | Mn | Mg | Cr | Zn | Ti |
| 3003 | 0.7 | 0.6 | 0.1 | 1.2 | — | — | 0.10 | — |
| 3004 | 0.7 | 0.30 | 0.25 | 1.2 | 1.0 | — | 0.25 | — |
| 5052 | 0.40 | 0.25 | 0.10 | 0.10 | 2.5 | 0.20 | 0.10 | — |
| 1030 | 0.6 | 0.35 | 0.10 | 0.10 | 0.05 | — | 0.10 | 0.03 |
| 8021 | 1.2 | 0.07 | 0.01 | — | — | — | 0.10 | — |
| 8079 | 0.9 | 0.07 | 0.01 | — | — | — | 0.10 | — |

In these alloys, a corrosive phenomenon referred to as "pitting corrosion" readily takes place in general. It is known that a surface of aluminum or an aluminum alloy is generally covered with a strong natural oxide film and hence excellent in corrosion resistance. When this oxide film is partially broken for some cause, however, corrosion takes place only in this portion and progresses in the depth direction. This phenomenon is referred to as pitting corrosion.

In order to prevent this pitting corrosion, Japanese Patent Laying-Open No. 3-261549, for example, discloses a cladding material having an aluminum film of high purity formed on its surface as a covering material. Japanese Patent Laying-Open No. 60-221546 discloses a technique of preventing pitting corrosion by adding zinc to an aluminum alloy. Further, Japanese Patent Laying-Open No. 10-183283 discloses an aluminum alloy cladding material excellent in corrosion resistance employing an aluminum alloy containing tin as a covering material.

When high-purity aluminum is employed as the covering material, however, dust is readily caused in forming due to excessive softness of the high-purity aluminum, to result in a problem of contamination.

When zinc or tin is added, the material is generally corroded although pitting corrosion can be prevented. Therefore, the quantity of corrosion is so large that the aluminum alloy is unsuitable for a container for food or the like.

Further, employment of a cladding material for a food container is generally unprofitable in consideration of the cost.

While high strength and formability are required to an aluminum alloy applied to a container for a beverage or food, those described in the aforementioned gazettes cannot sufficiently satisfy these characteristics.

High corrosion resistance and high strength are required also to an aluminum alloy foil for a building material employed as a heat insulating material, a wrapping material directed to prevention of deterioration of food or chemicals, a domestic article and a decorative article, for example, other than the container, i.e., in the field where the aluminum alloy foil is used with a thickness of not more than 50 μm. However, the aluminum alloys of the aforementioned JIS nominal 3003, 3004 are 5052 are so remarkably work-hardened in rolling that it is difficult to roll the aluminum alloys into foils of not more than 50 μm in thickness. In particular, it is practically impossible to obtain an aluminum alloy foil of not more than 20 μm.

Aluminum-iron alloys such as JIS nominal 8021 and 8079 shown in Table 1 are generally employed for these thin foils. In these alloys, however, presence of aluminum-iron intermetallic compounds reduces corrosion resistance and suppresses refinement of grains for attaining sufficient strength. Therefore, these aluminum alloys are insufficient in strength and never satisfactory.

Accordingly, the present invention has been proposed in order to solve the aforementioned problems, and an object of the present invention is to provide an aluminum alloy capable of preventing pitting corrosion and general corrosion without being worked into the form of a cladding material and excellent in strength, formability and workability, an aluminum alloy foil consisting of this aluminum alloy and a method of preparing the same, and a container employing this aluminum alloy foil.

DISCLOSURE OF THE INVENTION

In order to solve the aforementioned problems, the inventors have made various studies, to prove that copper and silicon are elements extremely reducing pitting corrosion resistance of an aluminum alloy while zinc and tin are elements causing general corrosion of the aluminum alloy under weak-acidic environment. Therefore, corrosion resistance of the aluminum alloy is reduced if any of these elements is added to the aluminum alloy.

It has also been proved that manganese, iron, chromium, titanium and zirconium are elements capable of increasing the strength without damaging the corrosion resistance of the aluminum alloy and providing sufficient elongation for improving the formability and high rollability for obtaining a thin foil by selecting proper contents and manufacturing conditions.

According to these recognitions, the inventors have succeeded in developing an aluminum alloy excellent in corrosion resistance, strength, formability and rollability.

An aluminum alloy according to an aspect of the present invention, proposed according to these recognitions, contains at least 0.0001 mass % and not more than 0.03 mass % of copper, at least 0.0005 mass % and not more than 0.2 mass % of silicon, at least 0.5 mass % and not more than 4 mass % of manganese and at least 0.5 mass % and not more than 3 mass % of iron, with the rest containing aluminum and unavoidable impurities.

Preferably, the aluminum alloy contains at least 0.0001 mass % and not more than 0.03 mass % of copper, at least 0.0005 mass % and not more than 0.2 mass % of silicon, at least 1.0 mass % and not more than 3.0 % of manganese and at least 0.7 mass % and not more than 1.2 mass % of iron, with the rest containing aluminum and unavoidable impurities.

An aluminum alloy according to another aspect of the present invention further contains at least one of at least 0.01 mass % and not more than 0.5 mass % of chromium, at least 0.01 mass % and not more than 0.5 mass % of titanium and at least 0.01 mass % and not more than 0.5 mass % of zirconium in either one of the aforementioned aluminum alloys.

An aluminum alloy foil according to the present invention consists of an aluminum alloy having any of the aforementioned compositions, and has a thickness, yield strength and elongation so selected that the relation between the yield strength YS ($N/mm^2$) and the thickness X ($\mu$m) satisfies an inequality YS>28.7 1n(X)−30 and the relation between the elongation El (%) and the thickness X ($\mu$m) satisfies an inequality El>0. 15X+3.5.

A method of preparing the aluminum alloy foil according to the present invention having the aforementioned mechanical characteristics comprises the following steps:

(a) A step of heating up an ingot of an aluminum alloy to a temperature of at least 350° C. and not more than 580° C.

(b) A step of hot-rolling the ingot of the aluminum alloy at a starting temperature of at least 350° C. and not more than 530° C. after the heating up thereby obtaining a plate material.

(c) A step of cold-rolling the plate material after the hot rolling.

(d) A step of softening the plate material after the cold rolling.

Preferably, the aforementioned preparation method further comprises a step of holding the ingot of the aluminum alloy at a temperature of at least 350° C. and not more than 580° C. for not more than 15 hours after the step of heating up the ingot, and carries out the step of hot-rolling the ingot for obtaining the plate material after this holding step.

Preferably, the aforementioned preparation method carries out the step of hot-rolling the ingot for obtaining the plate material immediately after the step of heating up the ingot.

The step of softening the plate material is preferably carried out by retaining the plate material at a temperature of at least 270° C. and not more than 380° C. for at least one hour and not more than 20 hours.

A more preferable aluminum alloy foil according to the present invention consists of an aluminum alloy containing at least 0.0001 mass % and not more than 0.01 mass % of copper, at least 0.0005 mass % and not more than 0.1 mass % of silicon, at least 1.0 mass % and not more than 3.0 mass % of manganese and at least 0.7 mass % and not more than 1.2 mass % of iron with the rest containing aluminum and unavoidable impurities, and has a thickness, yield strength and elongation so selected that the relation between the yield strength YS ($N/mm^2$) and the thickness X($\mu$m) satisfies an inequality YS>28.7 1n(X)−30 and the relation between the elongation El (%) and the thickness X($\mu$m) satisfies an inequality El>0.15X+3.5.

A container according to the present invention consists of the aforementioned aluminum alloy foil, and has a thickness of at least 50 $\mu$m and not more than 200 $\mu$m.

The reasons why the respective elements are added, the ranges of the contents thereof, conditions for methods of preparing the same and the like are now described in detail.

(1) Copper (Cu): at least 0.0001 mass % and not more than 0.03 mass %

Copper reduces corrosion resistance of the aluminum alloy when existing in the aluminum alloy in a small quantity. Therefore, the content of copper is set to not more than 0.03 mass %. The content of copper is set to at least 0.0001 mass % since the effect of improving pitting corrosion resistance is saturated while the cost is increased if the content of copper is set to less than 0.0001 mass %. Preferably, the content of copper is not more than 0.02 mass %, and more preferably not more than 0.01 mass %.

(2) Silicon (Si): at least 0.0005 mass % and not more than 0.2 mass %

If existing in the aluminum alloy, silicon remarkably reduces pitting corrosion resistance of the aluminum alloy against a saline solution or weak-acidic food. When the content of silicon is reduced, the grain size of the aluminum alloy is reduced. Thus, the yield strength of the aluminum alloy, i.e., the strength is increased, while the elongation of the aluminum alloy, i.e., the formability can also be improved. In order to derive these characteristics, the content of silicon must be set to at least 0.0005 mass % and not more than 0.2 mass %. The content of silicon is set to at least 0.0005 mass % since the aforementioned effect of improving the pitting corrosion resistance and the effects of increasing the formability and the strength are saturated while the cost is increased if the content of silicon is set to less than 0.0005 mass %. Preferably, the content of silicon is not more than 0.1 mass %.

(3) Manganese (Mn): at least 0.5 mass % and not more than 4 mass %

Manganese is an element improving the strength without remarkably reducing the corrosion resistance of the aluminum alloy. Sufficient strength cannot be attained if the content of manganese is less than 0.5 mass %. If the content of manganese exceeds 4 mass %, the elongation and the formability are reduced. Therefore, the content of manganese must be set to at least 0.5 mass % and not more than 4 mass %. In order to simultaneously implement corrosion resistance, strength, formability and rollability of the aluminum alloy, the content of manganese is more preferably set to at least 1.0 mass % and not more than 3.0 mass %.

When iron is added to the aluminum alloy, an intermetallic compound of aluminum-iron is formed. The presence of this intermetallic compound of aluminum-iron reduces the corrosion resistance. When manganese is added in this case, formation of the intermetallic compound of aluminum-iron reducing the corrosion resistance can be prevented. In other words, reduction of the corrosion resistance can be prevented by adding iron and manganese to the aluminum alloy thereby forming an intermetallic compound of aluminum-iron-manganese.

(4) Iron (Fe): at least 0.5 mass % and not more than 3 mass %

When the aforementioned manganese is independently added to the aluminum alloy, the softening temperature of the aluminum alloy is remarkably increased since manganese is solidly soluted in the aluminum alloy. Thus, the recrystallization temperature is also increased and the recrystallized grains are enlarged beyond necessity. If the recrystallized grains are excessively enlarged, the elongation and the yield strength of the aluminum alloy are reduced to disadvantageously reduce the formability and the strength.

When iron is added to the aluminum alloy, the quantity of solid soluted manganese in aluminum is remarkably reduced. Thus, the recrystallization temperature of the aluminum alloy is not increased beyond necessity, whereby the recrystallized grains are refined. Further, iron forms an intermetallic compound of aluminum-iron-manganese, thereby refining the recrystallized grains. More specifically, the size of the recrystallized grains reaches several $\mu$m.

Thus, the elongation and the yield strength of the aluminum alloy are remarkably improved, thereby improving the formability and the strength of a molded container.

Further, addition of iron does not remarkably reduce the corrosion resistance of the aluminum alloy since manganese is added. In addition, the fine intermetallic compound of aluminum-iron-manganese having high hardness remarkably reduces seizing and formation of fine powder when forming the container, whereby the formability can be further improved.

If the content of iron is less than 0.5 mass %, the aforementioned characteristics cannot be sufficiently derived. If the content of iron exceeds 3 mass %, the intermetallic compound of aluminum-iron-manganese is rendered coarse to reduce mechanical characteristics such as the yield strength and the elongation while also reducing the rollability. Therefore, the content of iron must be set to at least 0.5 mass % and not more than 3 mass %. In order to sufficiently derive the aforementioned characteristics, the content of iron is preferably set to at least 0.7 mass % and not more than 1.2 mass %.

(5) Chromium (Cr): at least 0.01 mass % and not more than 0.5 mass %

Chromium improves the strength of the aluminum alloy without remarkably reducing the corrosion resistance of the aluminum alloy. If the content of chromium is less than 0.01 mass %, the effect of improving the strength cannot be sufficiently attained. If the content of chromium exceeds 0.5 mass %, the formability is reduced. Therefore, the content of chromium must be set to at least 0.01 mass % and not more than 0.5 mass %. In order to implement excellent formability, the content of chromium is preferably set to not more than 0.25 mass %.

(6) Titanium (Ti): at least 0.01 mass % and not more than 0.5 mass %

Titanium improves the strength of the aluminum alloy without remarkably reducing the corrosion resistance of the aluminum alloy. Particularly when added to the aluminum alloy, titanium refines the coarse intermetallic compound of aluminum-iron-manganese causing a defect in forming. Thus, toughness can be supplied to the aluminum alloy. If the content of titanium is less than 0.01 mass %, the effects of improving the strength and supplying the toughness cannot be sufficiently attained. If the content of titanium exceed 0.5 mass %, the formability is reduced. Therefore, the content of titanium must be set to at least 0.01 mass % and not more than 0.5 mass %. In order to further derive the aforementioned effects, the content of titanium is preferably set to not more than 0.25 mass %.

(7) Zirconium (Zr): at least 0.0 1 mass % and not more than 0.5 mass %

While zirconium also improves the strength without remarkably reducing the corrosion resistance of the aluminum alloy, this effect is more remarkable than those of chromium and titanium. This is because addition of zirconium is extremely effective for refinement of recrystallized grains, whereby both of improvement of the strength and assurance of the elongation can be compatibly attained while the rollability is not reduced. The aforementioned effects cannot be derived if the content of zirconium is less than 0.01 mass %, while the elongation is reduced to deteriorate the formability if the content exceeds 0.5 mass %. In order to implement excellent strength, elongation and rollability, the content of zirconium is preferably set to not more than 0.35 mass %.

According to the present invention, as hereinabove described, the aforementioned additional elements are added into aluminum in the optimum quantities, whereby the recrystallized structure of the aluminum alloy is converted to a hyperfine structure. It is the feature of the aluminum alloy according to the present invention that the strength and the formability of the aluminum alloy can be thereby simultaneously improved.

The aluminum alloy according to the present invention may contain transition elements such as vanadium (V) and nickel (Ni) and elements such as magnesium (Mg), boron (B), gallium (Ga), zinc (Zn) and bismuth (Bi) with contents not influencing the aforementioned characteristics and effects.

(8) Mechanical Characteristics of Aluminum Alloy Foil

Assuming that X(μm) represents the thickness, the relation between the yield strength YS ($N/mm^2$) and the thickness X(μm) satisfies the following inequality:

$$YS>28.7\ 1n(X)-30$$

Further, the relation between the elongation El (%) and the thickness X(μm) satisfies the following inequality:

$$El>0.15X+3.5$$

The thickness, the yield strength and the elongation of the aluminum alloy foil are so selected as to satisfy the aforementioned two inequalities.

The strength and the elongation of the aluminum alloy foil vary with the thickness of the foil. In general, the elongation is reduced when the strength of the material is increased, while the strength is reduced when the elongation is increased. The strength and the elongation of the foil are reduced along with reduction of the thickness thereof. On the basis of such relation, the inventors have recognized that the aluminum alloy foil can have both strength and elongation necessary for a foil for a container, a foil for a building material, a foil for a food wrapping material and foils for domestic and decorative articles when the relation between the yield strength and the thickness as well as the relation between the elongation and the thickness satisfy the aforementioned two inequalities as the mechanical characteristics of the aluminum alloy foil. In other words, excellent formability and strength cannot be maintained in application to a container or the like unless the mechanical characteristics of the aluminum alloy foil are within the ranges of the aforementioned inequalities.

The yield strength of the aluminum alloy foil according to the present invention is about 160 $N/mm^2$ at the maximum, and the elongation is about 30%.

(9) Method of Preparing Aluminum Alloy Foil (9-1) Homogenization Temperature for Ingot of Aluminum Alloy: at least 350° C. and not more than 580° C.

The homogenization temperature is set to at least 350° C. and not more than 580° C., in order to finely precipitate manganese thereby suppressing grain growth in annealing and refining recrystallized grains. While homogenization may not be necessarily performed in a cast state, a problem such as a rolling crack arises in the subsequent hot rolling step in this case. Therefore, homogenization is preferably performed by heating up the ingot of the aluminum alloy to at least 350° C. before the subsequent hot rolling step, so that no crack is caused in this step. When the ingot of the aluminum alloy is heated up to a temperature exceeding 580° C., precipitation density of manganese is reduced resulting in low strength. Preferably, the homogenization temperature is at least 380° C. and not more than 500° C.

(9-2) Holding Time for Homogenization: at least 0 hour and not more than 15 hours The time for holding the ingot of the aluminum alloy after heating up the same to the temperature of at least 350° C. and not more than 580° C. is preferably as short as possible. Hot rolling may be performed immediately after heating up the ingot of the aluminum alloy to the aforementioned prescribed temperature, i.e., the holding time for homogenization may be set substantially to zero hour. If the holding time for homogenization exceeds 15 hours, the precipitation density of manganese is reduced resulting in low strength. Preferably, the holding time for homogenization is not more than 10 hours.

(9-3) Starting Temperature for Hot Rolling: at least 350° C. and not more than 530° C.

For the sake of workability of cold rolling after hot rolling and refinement of crystal grains after annealing, the hot rolling starting temperature is set to at least 350° C. and not more than 530° C. A crack is caused in hot rolling although no particular problem is caused in the characteristics of the aluminum alloy if the starting temperature is lower than 350° C., and hence the starting temperature is set to at least 350° C. If the starting temperature exceeds 530° C., crystal grains are rendered coarse when hot rolling is completed, and the recrystallized grains are insufficiently refined resulting in low strength in the finally obtained aluminum alloy foil. Preferably, the hot rolling starting temperature is within the range of at least 380° C. and not more than 480° C.

(9-4) Softening Conditions: at temperature of at least 270° C. and not more than 380° C. for at least one hour and not more than 20 hours The aluminum alloy foil obtained by performing cold rolling after hot rolling is softened for obtaining a soft foil. If the temperature for softening is less than 270° C. or the retention time is less than one hour as the condition for softening, recrystallization is so insufficiently performed that sufficient elongation cannot be attained. If the temperature for softening exceeds 380° C. or the holding time exceeds 20 hours to the contrary, the recrystallized grains are rendered coarse resulting in low strength and the elongation. In order to compatibly attain desired elongation and strength, the aluminum alloy foil must be softened at a temperature of at least 270° C. and not more than 380° C. for at least one hour and not more than 20 hours. If steps of homogenization and hot rolling out of the aforementioned conditions (9-1) to (9-3) are carried out before performing softening, no aluminum alloy foil having both of desired elongation and strength can be obtained even if the conditions for softening are changed.

(10) Thickness of Aluminum Alloy Foil: at least 50 μm and not more than 200 μm

If the thickness of the aluminum alloy foil is less than 50 μm, sufficient strength for serving as a container for food or the like cannot be maintained. If the thickness exceeds 200 μm, the aluminum alloy foil is hard to form. Therefore, the thickness of the aluminum alloy foil must be set to at least 50 μm and not more than 200 μm. More preferably, the thickness of the aluminum alloy foil is at least 50 μm and not more than 100 μm.

In the present invention, the content of copper and the content of silicon may be set to not more than 0.03 mass % and not more than 0.2 mass % respectively by a method of properly adding a primarily electrolyzed base metal or a high-purity aluminum base metal obtained by segregation or three-layer electrolysis to a common base metal of 99.3 mass % in purity for adjusting components, for example.

According to the present invention, as hereinabove described, it is possible to provide an aluminum alloy hardly causing both of pitting corrosion and general corrosion and capable of simultaneously improving strength and elongation. A container excellent in corrosion resistance and having high formability and strength can be provided at a low cost by working this aluminum alloy into an aluminum alloy foil as such to be applied to the container, without working the same into the form of a cladding material.

Further, the foil consisting of the aluminum alloy developed according to the present invention can exhibit sufficient effects not only for a container but also in the field of a thin foil required to be corrosion-resistant, i.e., in the field of foils for a building material serving as a heat insulating material, a wrapping material directed to prevention of deterioration of food or chemicals and domestic and decorative articles.

In addition, the composition of this aluminum alloy is not restricted to employment in the field of foil bases or foils but exhibits sufficient effects as the composition of a thicker plate material required to be corrosion-resistant or as the composition for powder metallurgy.

BEST MODES FOR CARRYING OUT THE INVENTION

Figure 1:
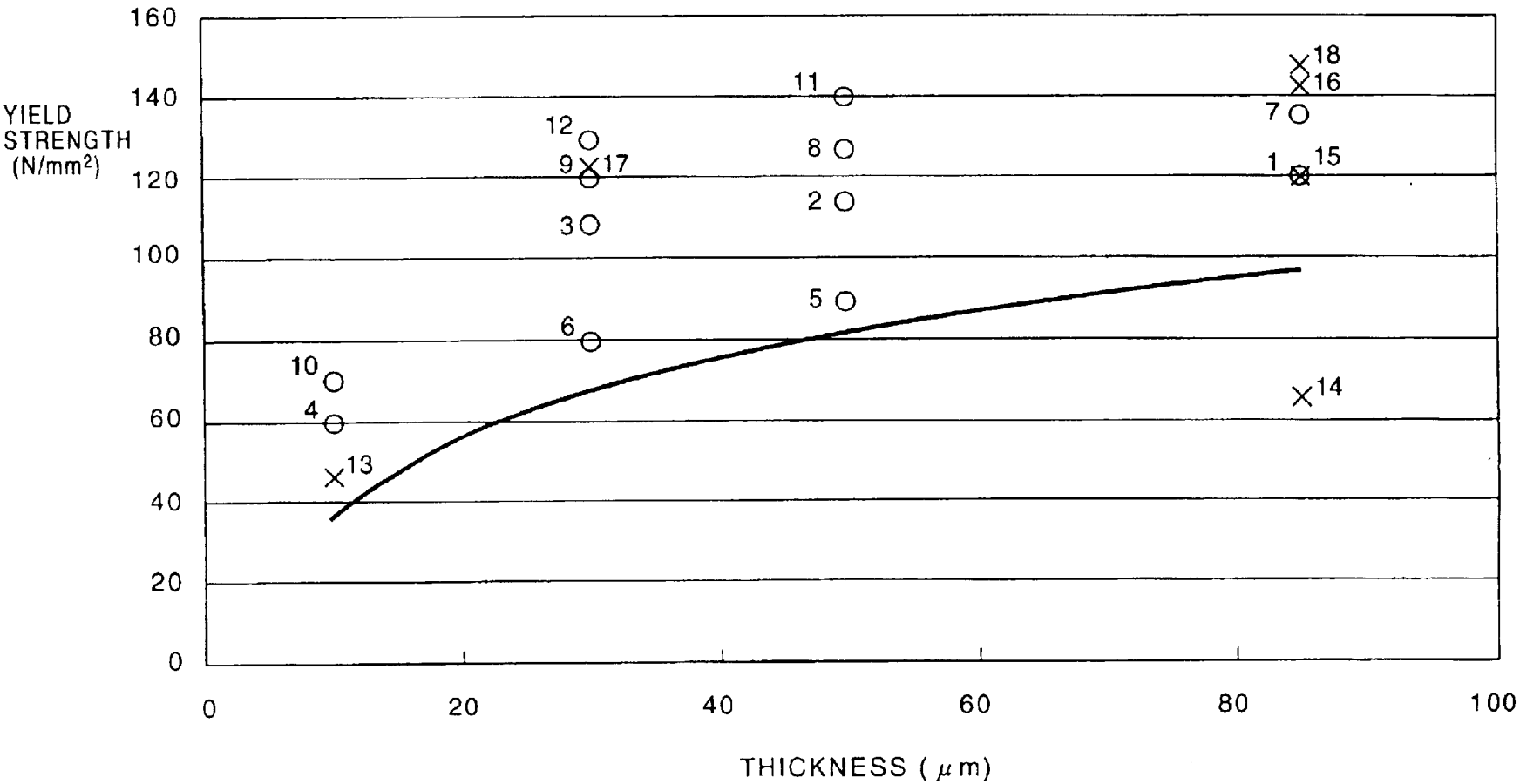
FIG. 1 illustrates the relation between the thickness and the yield strength of aluminum alloy foils according to Example of the present invention.

Examples of the present invention are now described.

(EXAMPLE 1)

First, aluminum alloys (compositions Nos. 1 to 23) of various compositions were melted and cast according to an ordinary method, for preparing ingots of the aluminum alloys. The compositions Nos. 24 to 26 correspond to the compositions of JIS nominal 3003, 3004 and 5052 respectively. Table 2 shows the compositions.

TABLE 2

| | Composition | Chemical Component (mass %) | | | | | | | | | |
|---|---|---|---|---|---|---|---|---|---|---|---|
| | No. | Mn | Fe | Si | Cu | Mg | Cr | Ti | Zr | Al | Remarks |
| Example | 1 | 1 | 0.8 | 0.1 | <0.01 | — | — | — | — | Rest | |
| | 2 | 1 | 1 | 0.2 | <0.01 | — | — | — | — | Rest | |
| | 3 | 1 | 1.3 | 0.1 | <0.01 | — | — | — | — | Rest | |
| | 4 | 1 | 1 | 0.1 | <0.01 | — | 0.1 | — | — | Rest | |
| | 5 | 1 | 1 | 0.1 | <0.01 | — | 0.5 | — | — | Rest | |
| | 6 | 1 | 1 | 0.1 | <0.01 | — | — | 0.1 | — | Rest | |
| | 7 | 1 | 1 | 0.1 | <0.01 | — | — | 0.5 | — | Rest | |
| | 8 | 1 | 1 | 0.1 | <0.01 | — | 0.05 | 0.05 | — | Rest | |

TABLE 2-continued

| | Composition No. | Chemical Component (mass %) Mn | Fe | Si | Cu | Mg | Cr | Ti | Zr | Al | Remarks |
|---|---|---|---|---|---|---|---|---|---|---|---|
| | 9 | 1 | 1 | 0.1 | <0.01 | — | 0.2 | 0.2 | — | Rest | |
| | 10 | 1 | 1 | 0.1 | <0.01 | — | — | — | 0.05 | Rest | |
| | 11 | 1 | 1 | 0.1 | <0.01 | — | — | — | 0.1 | Rest | |
| | 12 | 1 | 1 | 0.1 | <0.01 | — | — | — | 0.2 | Rest | |
| | 13 | 1 | 1 | 0.1 | <0.01 | — | — | — | 0.5 | Rest | |
| | 14 | 1 | 1 | 0.1 | <0.01 | — | 0.1 | 0.1 | 0.1 | Rest | |
| Comparative | 15 | 4.2* | 1 | 0.1 | <0.01 | — | — | — | — | Rest | |
| Example | 16 | 0.4* | 1 | 0.1 | <0.01 | — | — | — | — | Rest | |
| | 17 | 1 | 0.4* | 0.1 | <0.01 | — | — | — | — | Rest | |
| | 18 | 1 | 3.2* | 0.1 | <0.01 | — | — | — | — | Rest | |
| | 19 | 1 | 1 | 0.1 | 0.04* | | — | | — | Rest | |
| | 20 | 1 | 1 | 0.3* | <0.01 | — | — | — | — | Rest | |
| | 21 | 1 | 1 | 0.1 | <0.01 | — | 0.7* | — | — | Rest | |
| | 22 | 1 | 1 | 0.1 | <0.01 | — | — | 0.7* | — | Rest | |
| | 23 | 1 | 1 | 0.1 | <0.01 | — | — | — | 0.7* | Rest | |
| | 24 | 1 | 0.7 | 0.6 | 0.2 | — | — | — | — | Rest | JIS3003 |
| | 25 | 1 | 0.7 | 0.3 | 0.25 | 1 | — | — | — | Rest | JIS3004 |
| | 26 | 0.1 | 0.4 | 0.25 | 0.2 | 2.5 | 0.1 | — | — | Rest | JIS5052 |

Marks * indicate that the components are out of the inventive ranges.

Homogenization was carried out on these ingots of the aluminum alloys having the compositions Nos. 1 to 23 at a temperature of 480° C. for 5 hours, and hot rolling was started immediately after taking out the ingots from a furnace, thereby obtaining plate materials of 3 mm in thickness. Thereafter these plate materials were cold-rolled into foils of 85 $\mu$m in thickness, and annealed at a temperature of 300° C. for 10 hours as softening. The ingots of the conventional aluminum alloys having the compositions Nos. 24 to 26 were processed into soft foils of 85 $\mu$m in thickness by an ordinary method.

Mechanical characteristics (yield strength and elongation) of the obtained aluminum alloy foils were measured while the aluminum alloy foils were dipped in an aqueous solution of 50° C. in temperature containing 3 mass % of sodium chloride and 25 mass % of soy sauce for observing corroded states.

1000 sheets of 30 cm in diameter were prepared from each of the aluminum alloy foils having the compositions Nos. 1 to 26. Then, the respective sheets were formed with a composite die, thereby preparing 1000 food containers. As to the respective containers, defectives were detected with a pinhole detector for calculating forming defects rates.

Table 3 shows the results of the aforementioned measurement.

TABLE 3

| Composition No. | Yield strength (N/mm$^2$) | Elongation (%) | Corrosion Resistance | Forming Defects Rate (%) |
|---|---|---|---|---|
| | | Example | | |
| 1 | 105 | 26 | ○ | 0.1 |
| 2 | 110 | 26 | ○ | 0.1 |
| 3 | 115 | 25 | ○ | 0.15 |
| 4 | 115 | 25 | ○ | 0.2 |
| 5 | 125 | 20 | ○ | 0.2 |
| 6 | 112 | 25 | ○ | 0.15 |
| 7 | 118 | 20 | ○ | 0.2 |
| 8 | 125 | 26 | ○ | 0.1 |
| 9 | 128 | 24 | ○ | 0.2 |
| 10 | 112 | 26 | ○ | 0.1 |
| 11 | 118 | 26 | ○ | 0.1 |

TABLE 3-continued

| Composition No. | Yield strength (N/mm$^2$) | Elongation (%) | Corrosion Resistance | Forming Defects Rate (%) |
|---|---|---|---|---|
| 12 | 128 | 26 | ○ | 0.1 |
| 13 | 135 | 20 | ○ | 0.15 |
| 14 | 130 | 25 | ○ | 0.15 |
| | | Comparative Example | | |
| 15 | 120 | 10 | ○ | 4 |
| 16 | 60 | 25 | ○ | 0.5 |
| 17 | 70 | 20 | ○ | 0.5 |
| 18 | 70 | 13 | Δ | 4 |
| 19 | 111 | 25 | X | 0.1 |
| 20 | 60 | 20 | X | 0.3 |
| 21 | 145 | 7 | Δ | 2 |
| 22 | 121 | 9 | Δ | 2 |
| 23 | 150 | 12 | ○ | 0.3 |
| 24 | 60 | 18 | X | 0.5 |
| 25 | 80 | 18 | X | 0.5 |
| 26 | 100 | 20 | X | 3 |

○: not corroded.
Δ: slightly corroded.
X: considerably corroded.

It is understood from Table 3 that the aluminum alloy foils having the compositions Nos. 1 to 14 according to the present invention are superior to the conventional aluminum alloys (compositions Nos. 24 to 26) of the JIS nominal 3003, 3004 and 5052 in all of yield strength, elongation, corrosion resistance and forming defects ratio.

It is understood that the aluminum alloy foils having the compositions Nos. 1 to 14 according to the present invention are superior also to the aluminum alloy foils having the compositions Nos. 15 to 23 out of the ranges of the present invention in total evaluation of yield strength, elongation, corrosion resistance and forming defects ratio.

(EXAMPLE 2)

Ingots of the aluminum alloys having the compositions Nos. 1 and 11 prepared in Example 1 were worked under various preparation conditions into foils of 85 $\mu$m in thickness, and thereafter softened within the temperature range of 280 to 340° C. Table 4 shows preparation conditions employed at this time, mechanical characteristics of the softened aluminum alloy foils and forming defects rates evaluated by the method described with reference to Example 1.

TABLE 4

| | | Homogenization Condition | | Hot Rolling Starting | Composition No. 1 | | | Composition No. 11 | | |
|---|---|---|---|---|---|---|---|---|---|---|
| | Step | Temperature (° C.) | Time (hr) | Temperature (° C.) | Yield strength (N/mm$^2$) | Elongation (%) | Forming Defects Rate (%) | Yield strength (N/mm$^2$) | Elongation (%) | Forming Defects Rate (%) |
| Example | A | 480 | 5 | 450 | 105 | 2G | 0.1 | 118 | 24 | 0.15 |
| | B | 450 | 5 | 420 | 115 | 25 | 0.1 | 130 | 24 | 0.2 |
| | C | 420 | 5 | 400 | 120 | 25 | 0.15 | 135 | 23 | 0.2 |
| | D | 570 | 10 | 480 | 102 | 24 | 0.1 | 110 | 24 | 0.1 |
| Comparative Example | E | 340* | 5 | 340* | rolling end crack | | | rolling end crack | | |
| | F | 610* | 10 | 450 | 67 | 27 | <0.1 | 78 | 26 | <0.1 |
| | G | 570 | 20* | 450 | 68 | 27 | <0.1 | 76 | 26 | <0.1 |
| | H | 540 | 5 | 540* | 64 | 26 | <0.1 | 72 | 25 | <0.1 |

Marks * indicate that the preparation conditions are out of the ranges of the present invention.

It is understood from Table 4 that aluminum alloy foils prepared through steps A, B, C and D according to the present invention exhibited excellent results in yield strength, elongation and formability while aluminum alloy foils prepared through steps E, F, G and H out of the ranges of the present invention caused problems in rolling steps or had problems such as low strength.

(EXAMPLE 3)

Aluminum alloy foils having different thicknesses were prepared by combining the compositions and the steps employed in Examples 1 and 2, and softened within the temperature range of 280 to 340° C. Thereafter mechanical characteristics were measured as to the respective aluminum alloy foils. Table 5 shows the results.

TABLE 5

| Sample No. | Composition No. | Step | Thickness (μm) | Yield strength (N/mm$^2$) | Elongation (%) |
|---|---|---|---|---|---|
| | | Example | | | |
| 1 | 1 | C | 85 | 120 | 25 |
| 2 | 1 | C | 50 | 115 | 20 |
| 3 | 1 | C | 30 | 110 | 16 |
| 4 | 1 | C | 10 | 60 | 8 |
| 5 | 1 | B | 30 | 90 | 21 |
| 6 | 1 | D | 30 | 80 | 16 |
| 7 | 11 | C | 85 | 135 | 24 |
| 8 | 11 | C | 50 | 128 | 19 |
| 9 | 11 | C | 30 | 120 | 16 |
| 10 | 11 | C | 10 | 70 | 8 |
| 11 | 12 | A | 50 | 140 | 12 |
| 12 | 13 | C | 30 | 130 | 10 |
| | | Comparative Example | | | |
| 13 | 1 | F* | 10 | 46 | 2* |
| 14 | 1 | F* | 85 | 67* | 27 |
| 15 | 15* | C | 85 | 120 | 10* |
| 16 | 21* | C | 85 | 145 | 7* |
| 17 | 21* | C | 30 | 122 | 5* |
| 18 | 23* | C | 85 | 150 | 12* |

Marks* indicate that the yield strength or elongation is separated from the range of the present invention due to steps out of the inventive ranges.

It is understood from the results shown in Table 5 that aluminum alloy foils prepared in compositions and steps according to the present invention are hardly work-hardened and hence excellent in rolling workability, can be rolled into thicknesses of about 10 μm of the so-called thin foil, and excellent in balance between yield strength and elongation in the respective thicknesses.

Figure 2:
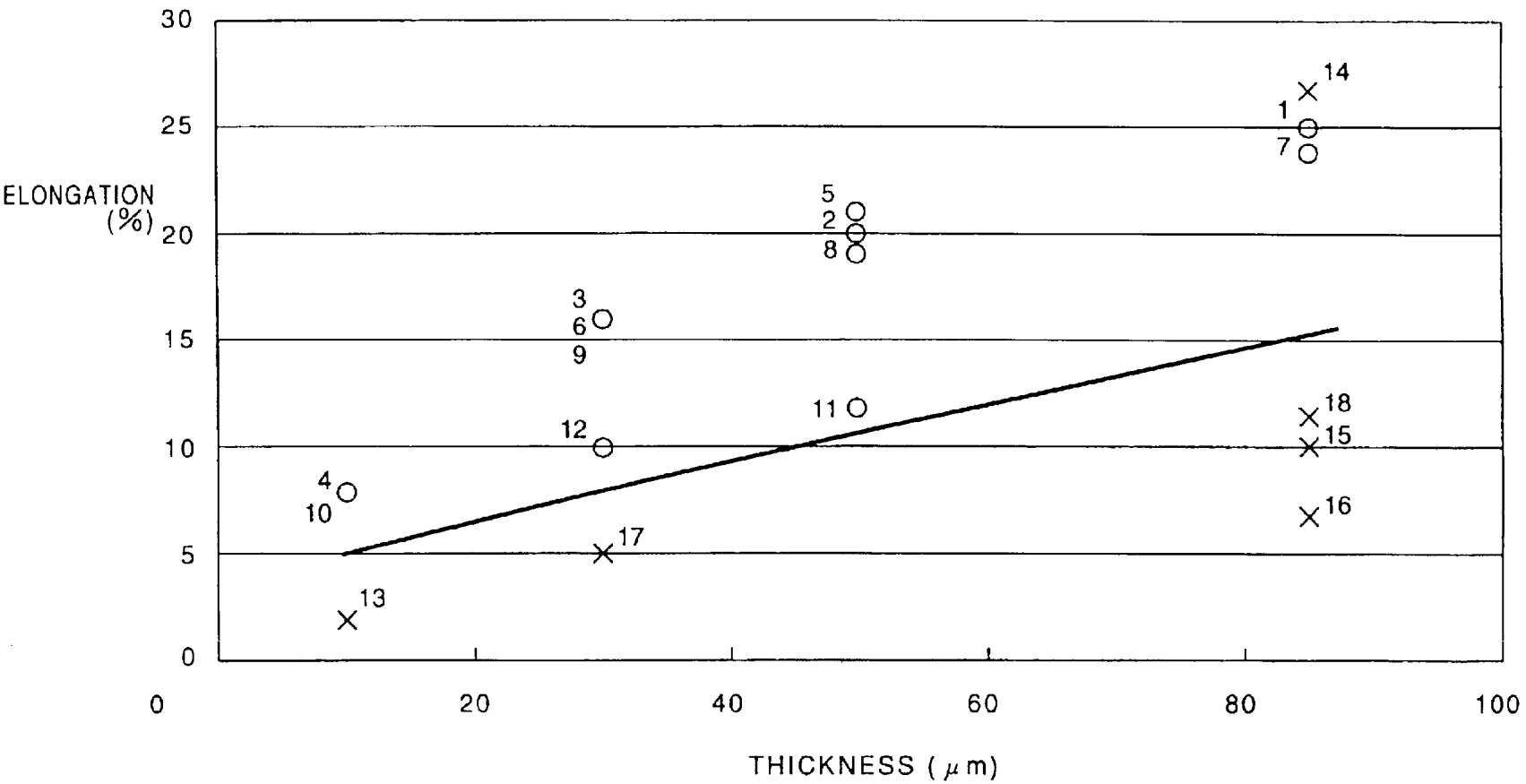
FIG. 2 illustrates the relation between the thickness and the elongation of the aluminum alloy foils according to Example of the present invention.

FIG. 1 shows the relation between the thickness and the yield strength of each sample shown in Table 5, and FIG. 2 shows the relation between the thickness and the elongation of each sample shown in Table 5. Referring to FIGS. 1 and 2, marks ○ denote the samples of inventive Examples, and marks x denote samples of comparative examples. Numbers provided on the left sides of the marks ○ and numbers provided on the right sides of the marks x denote the numbers of the samples respectively. A curve shown in FIG. 1 corresponds to a curve expressed in the equation of yield strength YS (N/mm$^2$)=28.7 1n(X)−30 assuming that X(μm) represents the thickness of the aluminum alloy foil, and a straight line shown in FIG. 2 corresponds to a straight line expressed in the equation of the elongation El(%)=0.15X+3.5.

It is understood from FIGS. 1 and 2 that the samples Nos. 1 to 12 of inventive Examples satisfy the inequality YS>28.7 1n(X)−30 indicating the relation between the yield strength and the thickness and the inequality El>0.15X+3.5 indicating the relation between the elongation and the thickness, while the samples Nos. 13 to 18 of comparative examples do not satisfy either one of the aforementioned two inequalities.

It is also understood that the aluminum alloys of JIS nominal 8021 and 8079 generally employed for thin foils have yield strength and elongation of about 40 N/mm$^2$ and 8 % respectively at the most with a thickness of 10 μm and exhibit no corrosion resistance dissimilarly to the inventive aluminum alloy, and hence the aluminum alloy disclosed in the present invention is extremely effective also for a thin foil.

Examples disclosed herein are considered to be illustrative in all points and not restrictive. The scope of the present invention is defined not by the aforementioned Examples but by the scope of the claims for patent, and it is intended that all corrections and modifications within the meaning and the range equivalent to the scope of the claims for patent are included.

The aluminum alloy and the aluminum alloy foil according to the present invention, having high strength and sufficient elongation improving formability and exhibiting excellent rollability, can be applied to an aluminum alloy or an aluminum alloy foil for a container for beverages or food, a building material, a food wrapping material and domestic and decorative articles, while the composition of the aluminum alloy according to the present invention is not restricted to application in the field of foil or foil stock but can be sufficiently applied to a thicker plate material required to be corrosion-resistant or powder metallurgy.

What is claimed is:

1. An aluminum alloy consisting of at least 0.0001 mass % and not more than 0.01 mass % of copper, at least 0.0005 mass % and not more than 0.1 mass % of silicon, at least 1.0 mass % and not more than 3.0 mass % of manganese, at least 0.7 mass % and not more than 1.2 mass % of iron, at least 0.0 mass % and not more than 0.5 mass % of each of at least one additional element selected from a group consisting of chromium, titanium and zirconium, and a remainder consisting of aluminum and unavoidable impurities.

2. The aluminum alloy according to claim 1, wherein a content of each of said at least one additional element is at least 0.01 mass %.

3. An aluminum alloy foil consisting of the aluminum alloy, according to claim 1, and having a thickness, elongation and yield strength so selected that the relation between the yield strength YS ($N/mm^2$) and the thickness X($\mu$m) satisfies an inequality YS>28.7 1n(X)−30 and the relation between the elongation El (%) and the thickness X ($\mu$m) satisfies an inequality El>0.15X+3.5.

4. A method of preparing the aluminum alloy foil according to claim 3, comprising steps of:

heating up an ingot of said aluminum alloy to a temperature of at least 350° C. and not more than 580° C.;

hot-rolling said ingot of said aluminum alloy at a starting temperature of at least 350° C. and not more than 530° C. after the heating up thereby obtaining a plate material;

cold-rolling said plate material after the hot rolling; and softening said plate material after the cold rolling.

5. The method of preparing the aluminum alloy foil according to claim 4, further comprising a step of retaining said ingot of said aluminum alloy at a temperature of at least 350° C. and not more than 580° C. for not more than 15 hours after said step of heating up said ingot, and carrying out said step of hot-rolling said ingot for obtaining said plate material after said holding step.

6. The method of preparing the aluminum alloy foil according to claim 4, comprising carrying out said step of hot-rolling said ingot for obtaining said plate material immediately after said step of heating up said ingot.

7. The method of preparing the aluminum alloy foil according to claim 4, wherein said step of softening said plate material includes an operation of retaining said plate material at a temperature of at least 270° C. and not more than 380° C. for at least one hour and not more than 20 hours.

8. The aluminum alloy according to claim 1, containing more than 1.0 mass % of said manganese.

9. An article of manufacture, said article of manufacture consisting of the aluminum alloy according to claim 1, and said article of manufacture being an article selected from the group consisting of a container, a food wrapping foil material, a domestic article, and a decorative article.

10. An aluminum alloy foil consisting of an aluminum alloy consisting of at least 0.0001 mass % and not more than 0.01 mass % of copper, at least 0.0005 mass % and not more than 0.1 mass % of silicon, at least 1.0 mass % and not more than 3.0 mass % of manganese, at least 0.7 mass % and not more than 1.2 mass % of iron, at least 0.0 mass % and not more than 0.5 mass % of each of at least one additional element selected from a group consisting of chromium, titanium and zirconium, and a remainder consisting of aluminum and unavoidable impurities, and having a thickness, elongation and yield strength so selected that the relation between the yield strength YS ($N/mm^2$) and the thickness X ($\mu$m) satisfies an inequality YS>28.7 1n(X)−30 and the relation between the elongation El (%) and the thickness is X ($\mu$m) satisfies an inequality El>0.15X+3.5.

11. A container consisting of the aluminum alloy foil according to claim 10, and having a thickness of at least 50 $\mu$m and not more than 200 $\mu$m.

12. An aluminum alloy consisting of:

0.0001 to 0.01 mass % of copper;

0.0005 to 0.1 mass % of silicon;

1.0 to 3.0 mass % of manganese;

0.7 to 1.2 mass % of iron;

0.0 to 0.5 mass % of each of at least one additional element selected from a group consisting of chromium, a titanium and zirconium; and a remainder consisting of aluminum and unavoidable trace amounts of unavoidable impurities.

13. The aluminum alloy according to claim 12, including at least 0.01 mass % of each of at least one said additional element selected from said group.

14. The aluminum alloy according to claim 12, including not more than an unavoidable trace amount of each said additional element selected from said group.

15. An aluminum alloy foil consisting of the aluminum alloy according to claim 12, and having a thickness, elongation and yield strength so selected that the relation between the yield strength YS ($N/mm^2$) and the thickness X ($\mu$m) satisfies an inequality YS>28.7 1n(X)−30 and the relation between the elongation El (%) and the thickness X ($\mu$m) satisfies an inequality El>0.15X+3.5.

16. The aluminum alloy according to claim 12, containing more than 1.0 mass % of said manganese.

* * * * *

UNITED STATES PATENT AND TRADEMARK OFFICE

CERTIFICATE OF CORRECTION

PATENT NO. : 6,736,911 B1
DATED : May 18, 2004
INVENTOR(S) : Akinori Ro

It is certified that error appears in the above-identified patent and that said Letters Patent is hereby corrected as shown below:

Title page,
Item [*] Notice, delete the phrase "by 24 days" and insert -- by 12 days --.

Signed and Sealed this

Sixteenth Day of August, 2005

JON W. DUDAS
*Director of the United States Patent and Trademark Office*